US006089046A

United States Patent [19]

Nilsson

[11] Patent Number: 6,089,046

[45] Date of Patent: Jul. 18, 2000

[54] METHOD FOR PRODUCING POCKETS ON A KNITTED GARMENT

[75] Inventor: Eivor Nilsson, Uppsala, Sweden

[73] Assignee: Kriss AG, Sparsor, Sweden

[21] Appl. No.: 08/828,219

[22] Filed: Feb. 11, 1997

Related U.S. Application Data

[63] Continuation of application No. PCT/SE95/00903, Jul. 31, 1995.

[30] Foreign Application Priority Data

Aug. 12, 1994 [SE] Sweden ..... 9402723

[51] Int. Cl.[7] ..... D04B 9/54

[52] U.S. Cl. ..... 66/60 R; 66/173

[58] Field of Search ..... 66/64, 60 R, 169 R, 66/170, 171, 172 R, 173, 175, 176, 177, 178 R, 180, 189, 200, 201

[56] References Cited

U.S. PATENT DOCUMENTS

| | | | |
|---|---|---|---|
| 1,072,640 | 9/1913 | Nydegger . | |
| 1,092,144 | 4/1914 | Grushlaw | 66/176 |
| 1,572,434 | 3/1926 | Kaiser . | |
| 3,093,989 | 6/1963 | Breitinger . | |
| 3,635,051 | 1/1972 | Betts et al. | 66/176 |
| 3,813,901 | 6/1974 | Betts et al. . | |
| 4,040,275 | 8/1977 | Castello . | |
| 4,087,991 | 5/1978 | Robinson et al. . | |
| 4,102,155 | 7/1978 | Robinson et al. | 66/176 |
| 4,107,955 | 8/1978 | Robinson et al. | 66/176 |
| 4,111,009 | 9/1978 | Robinson et al. | 66/176 |
| 5,214,941 | 6/1993 | Essig . | |
| 5,321,959 | 6/1994 | Mitsumoto . | |

FOREIGN PATENT DOCUMENTS

| | | | |
|---|---|---|---|
| 92308499 | 9/1992 | European Pat. Off. . | |
| 0705929 | 10/1996 | European Pat. Off. . | |
| 2715439 | 10/1977 | Germany | 66/176 |
| 1549777 | 8/1979 | United Kingdom . | |
| WO 9605345 | 2/1996 | WIPO . | |

*Primary Examiner*—John J. Calvert
*Assistant Examiner*—Larry D. Wonell, Jr.
*Attorney, Agent, or Firm*—Merchant & Gould P.C.

[57] ABSTRACT

A method for producing one or more pockets (13) in a knitted ready-made garment. The method comprises knitting a piece of tricot (10) having a rectangular configuration with two long sides (11) and two short sides (12). The piece of tricot is folded in at least two places, substantially in parallel with the short sides for forming the back- and side parts of the garment. The remaining parts of the tricot piece at the short sides form a divided front and an arm opening is made at each side part of the tricot piece. The tricot piece is knitted with needles in single bed or double bed or in a combination of those beds, up to a point where a pocket (13) is to be located. A segment corresponding to the two sides of the pocket is knitted in a single bed. The remaining part of the tricot piece is finished by knitting in single or double bed or in a combination of this and the two sides of each pocket are stitched together by seams.

3 Claims, 1 Drawing Sheet

METHOD FOR PRODUCING POCKETS ON A KNITTED GARMENT

This application is a continuation of PCT/SE95/00903, filed Jul. 31, 1995.

TECHNICAL FIELD

The present invention refers to a method for producing one or more pockets in a knitted ready-made garment, comprising knitting a piece of tricot having a rectangular configuration with two long sides and two short sides, folding the piece of tricot in at least two places, substantially in parallel with the short sides for forming the back- and side parts of the garment, wherein the remaining parts of the tricot piece at the short sides form a divided front, and making an arm opening at each side part of the tricot piece.

BACKGROUND OF THE INVENTION

Traditional manufacturing of ready-made garments, e.g. jackets or waistcoats, usually comprises cutting sections and stitching them together into a complete garment. This assembly of the garment is labour-intensive and requires a high degree of precision in order to make the garment fulfill the demands regarding quality and trueness to size. If the garment is provided with a pattern, cutting and assembly should be performed with regard to the pattern which often causes spillage of fabric.

The same goes for knitted garments, with the exception that the different parts which form the garment may be knitted to substantially the right shape separately, without any cutting. However, the assembly of the parts is just as labour-intensive and involves the risk of faults in the production.

It is known to manufacture knitted jackets or waistcoats by knitting a large rectangle. This knitting may be performed in computer controlled knitting machines with single or double bed or a combination of this, which enables patterns and structure knitting. By folding the rectangle at two places, it will form the back piece, the side pieces and a divided garment front. This method reduces the manual work effort during assembly of the garment. Openings are made at the sides, either for forming the arm openings of a waistcoat, or for mounting the arms of a jacket.

Thus, the rationalization of manufacturing of knitted garments has reached far. However, if the garment is to be provided with pockets, the attachment of these pockets involves a lot of labour.

THE TECHNICAL PROBLEM

One object of the present invention is therefore to further simplify and reduce the manual work effort during manufacturing of these garments, so that garments with pockets do not require so much labour.

THE SOLUTION

For this purpose, the method according to the invention is characterized in that the tricot piece is knitted with needles in single bed or double bed or in a combination of those beds, up to a point where a pocket is to be located, that a segment corresponding to the two sides of the pocket is knitted in a single bed, that the remaining part of the tricot piece is finished by knitting in single or double bed or in a combination of this, and that the two sides of each pocket are stitched together by seams.

DESCRIPTION OF THE DRAWINGS

The invention will be described here below with reference to an embodiment shown in the accompanying drawing, in which a tricot piece having pockets according to the invention, is shown in a plane view.

DESCRIPTION OF EMBODIMENTS

Figure 1:
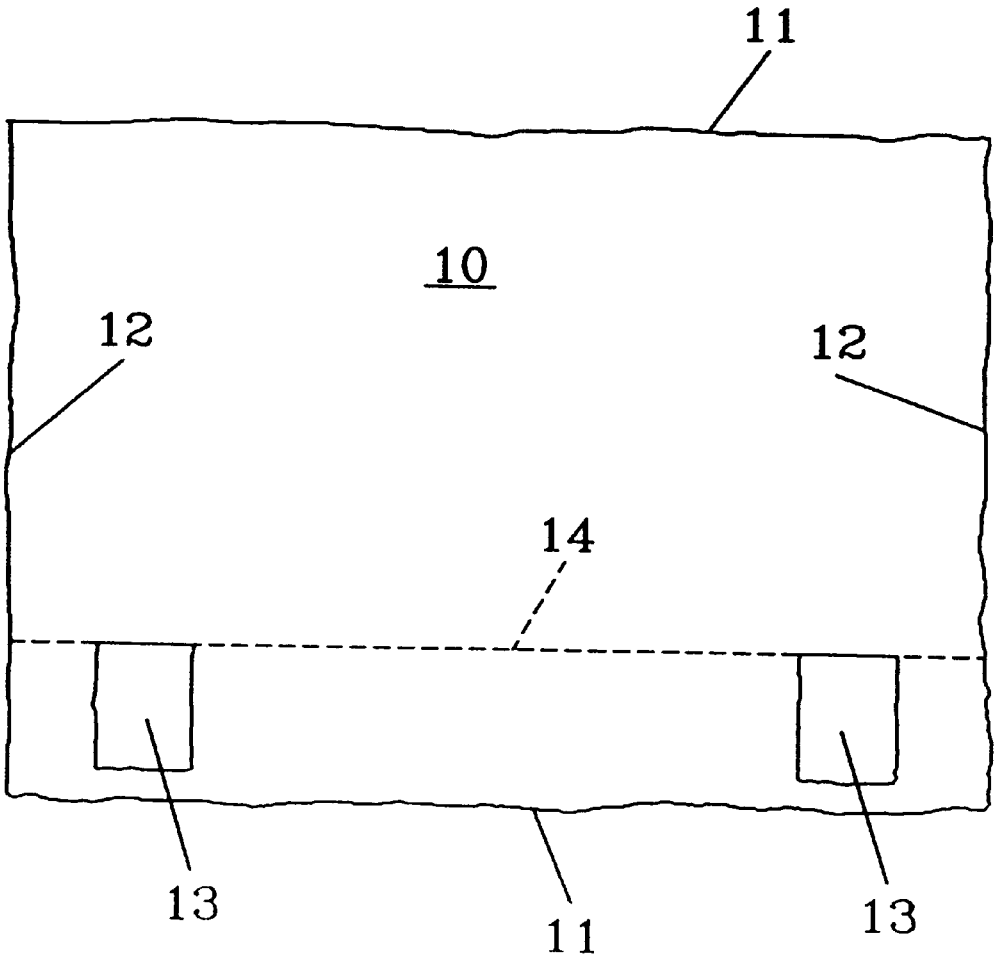

The figure shows a tricot piece 10 which has bean knitted in a rectangular shape with two long sides 11 and two short sides 12. Two pockets 13 are located with their openings in line with the broken line 14 adjacent the bottom long side.

By folding the tricot piece in at least two places, substantially in parallel with the short sides, the back piece and the side pieces of the jacket are formed. The remaining parts of the tricot piece adjacent the short sides together form the divided front part. Arms may be attached to each side part of the tricot piece after making arm openings.

The tricot piece is knitted with needles in a so called single bed or double bed or in a combination of those beds, in the direction from one or the other long side 11, onto a point where the pockets 13 are to be located.

Then a segment corresponding to the two sides of the pocket is knitted in a single bed. The remaining part of the tricot piece is finished by-knitting correspondingly in single or double bed or in a combination of this. Finally, the two sides of each pocket is stitched together by seams.

An edge, for example a loop piping may also be knitted along the pocket opening.

Owing to that pockets in this way are positioned at exact places on the entire tricot piece which is formed into the front and back parts of the garment, many time consuming work operations may be omitted in manufacturing of garments.

The pockets may be located optionally as back pockets, side pockets, breast pockets or front pockets. The garment may be designed as a waistcoat or a jacket, without folded front parts or with front parts which are folded outward or inward.

I claim:

1. A method for producing one or more pockets (13) in a knitted ready-made garment, comprising:

knitting a tricot piece (10) with needles in single bed or double bed or in a combination of these, up to a point where a pocket (13) comprising two sides is to be located, the tricot piece having a rectangular configuration with two long sides (11) and two short sides (12);

knitting a segment corresponding to the two sides of the pocket in single bed;

knitting a remainder of the tricot piece in single bed or double bed or a combination of these;

stitching together the two sides of each pocket by seams;

folding the tricot piece in at least two places, substantially in parallel with the short sides for forming back and side parts of the garment, wherein remaining parts of the tricot piece form a divided front; and making an arm opening at each side of the tricot piece.

2. The method according to claim 1, further comprising knitting an edge adjacent an opening of the pocket.

3. The method according to claim 2, wherein knitting the edge comprises knitting a loop piping.

* * * * *